United States Patent [19]

Abarotin et al.

[11] 3,975,045

[45] Aug. 17, 1976

[54] BITS FOR INGOT TONGS

[75] Inventors: Eugene V. Abarotin, Franklin Township, Westmoreland County; Michael A. Buckiso, Whitehall Borough, both of Pa.

[73] Assignee: United States Steel Corporation, Pittsburgh, Pa.

[22] Filed: Feb. 27, 1975

[21] Appl. No.: 553,764

[52] U.S. Cl. ..... 294/86 R; 294/106

[51] Int. Cl.[2] ..... B66C 1/48

[58] Field of Search ..... 294/82 R, 86 R, 101, 294/104, 106, 118, DIG. 1, DIG. 2; 81/421–424; 269/271, 272, 279, 280, 283

[56] References Cited

UNITED STATES PATENTS

| | | | |
|---|---|---|---|
| 1,050,479 | 1/1913 | Long | 294/82 R |
| 2,326,962 | 8/1943 | Meier | 294/118 |
| 2,398,464 | 4/1946 | Salisbury | 294/82 R |
| 2,705,658 | 4/1955 | Barchoff | 294/118 |
| 3,061,357 | 10/1962 | Wright | 294/106 |
| 3,269,766 | 8/1966 | Gardner | 294/101 |

*Primary Examiner*—Johnny D. Cherry
*Attorney, Agent, or Firm*—Walter P. Wood

[57] ABSTRACT

Improved bits for ingot tongs, an improved tong-and-bit combination, and an improved method of handling ingots. The bits are formed of a durable metal, such as a nickel alloy or a cobalt alloy, and are rotatably fastened in the tong arms. Protrusions from the outside faces of the tong arms are avoided to prevent damage to parts struck by the tongs. The distance by which the points on the bits protrude from the inside faces of the tong arms can be adjusted for different sizes of ingots. The method includes a step of rotating the bits through a small arc each time an ingot is set down, whereby a fresh area is presented upwardly after each use and wear on the bit point is distributed around the circumference.

15 Claims, 6 Drawing Figures

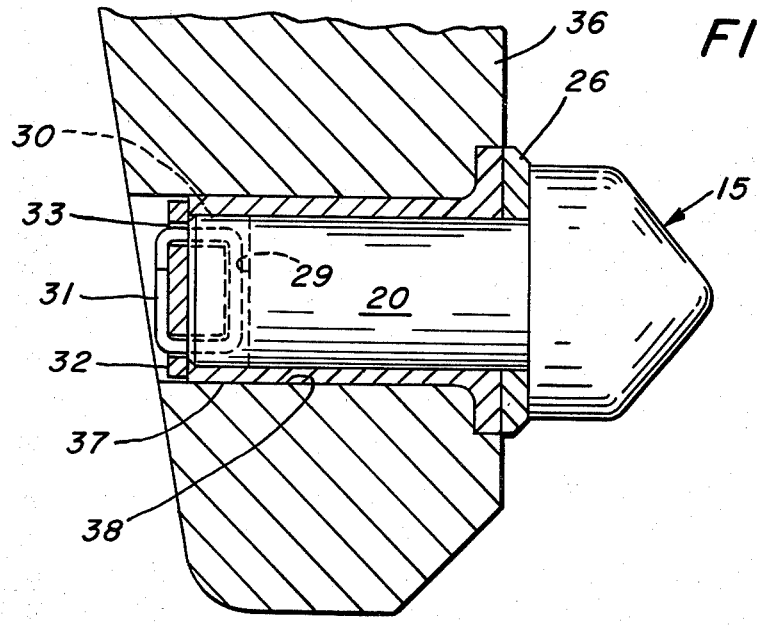
FIG. 4.
FIG. 5.
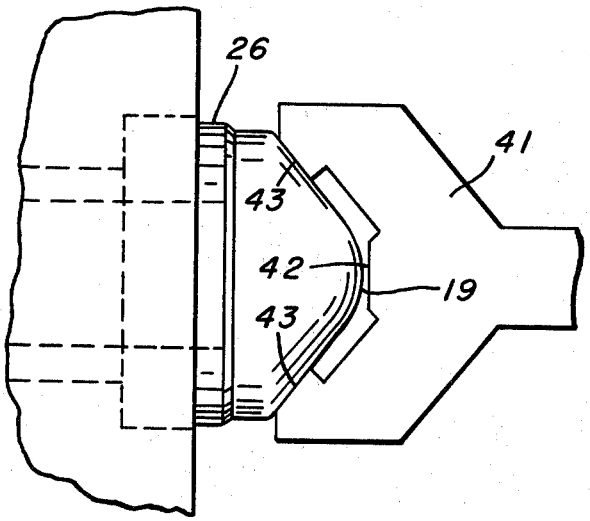
FIG. 6.
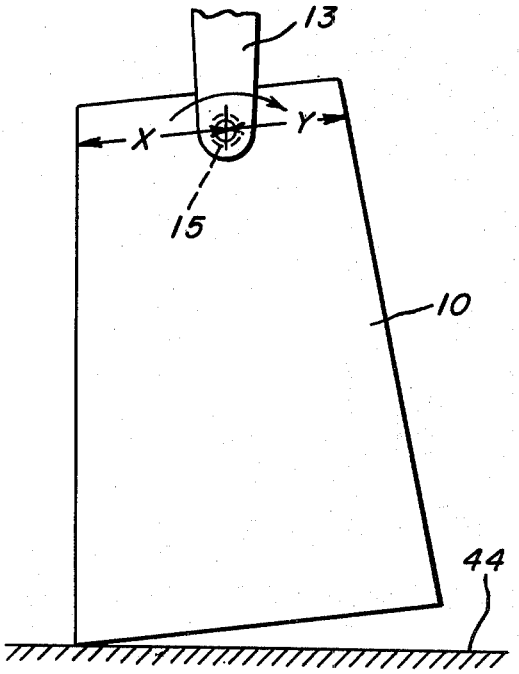

BITS FOR INGOT TONGS

This invention relates to improved bits for ingot tongs, to an improved tong-and-bit combination, and to an improved method of handling ingots to increase bit life.

Conventional practice in handling and transporting metal ingots, which weigh several tons and may be at elevated temperatures, is to engage the ingot with tongs carried by a suitable crane. The tongs have opposed relatively movable arms which carry bits for biting into the side faces of the ingot and thus gripping and supporting the ingot. Usually bits are formed of steel, such as AISI 1030 or 4140, and have shanks fixed in bores in the tong arms, sometimes within bushings inserted in the bores. The most common way of fastening a bit to a tong arm is by use of a pin inserted through a transverse hole in the shank at the outside face of the arm. The bit has a wedge-shaped or conical point at its inside end, the apex angle of which most commonly is less than a right angle.

Bits used heretofore have been short-lived, and normally must be replaced after each turn. A steel bit should be water-cooled after each ingot is carried, or its life is even shorter. Use of a pin to fasten the bit to the arm necessitates that the bit shank protrude beyond the outside face of the arm. A protruding shank may strike refractory walls of a soaking pit in which the ingot is heated and damage these walls. There has been no provision for adjusting the distance by which the point protrudes from the inside face of the arm for handling ingots of different sizes. The indentations left in ingot surfaces by relatively sharp pointed bits may cause defects which must be removed by scarfing or machining. The bit point wears almost exclusively at its upper surface, but there is no provision for rotating the bit and thus distributing the wear.

An object of our invention is to provide an improved bit and an improved tong-and-bit combination which overcome the foregoing disadvantages and greatly prolong bit life.

A further object is to provide a bit formed of a material which does not require water-cooling and, by reason of this material and improved fastening means, lasts through many turns.

A further object is to provide an improved tong-and-bit combination in which the bit can rotate relative to the tong arm to distribute wear around the circumference of the point.

A further object is to provide an improved means for fastening a bit to a tong arm in which the distance the point protrudes from the inside face of the arm can be adjusted for handling ingots of different sizes.

A further object is to provide an improved method of handling ingots in which the bits rotate through a small arc each time an ingot is set down, whereby wear on the point is distributed around the circumference.

In the drawings:

FIG. 4 is a vertical sectional view similar to FIG. 2, but showing a modification;

FIG. 5 is a side elevational view of a tong arm and bit illustrating a procedure by which we determine when our bit has worn excessively; and FIG. 6 is a diagrammatic view of an ingot and tongs illustrating our handling method.

Figure 1:
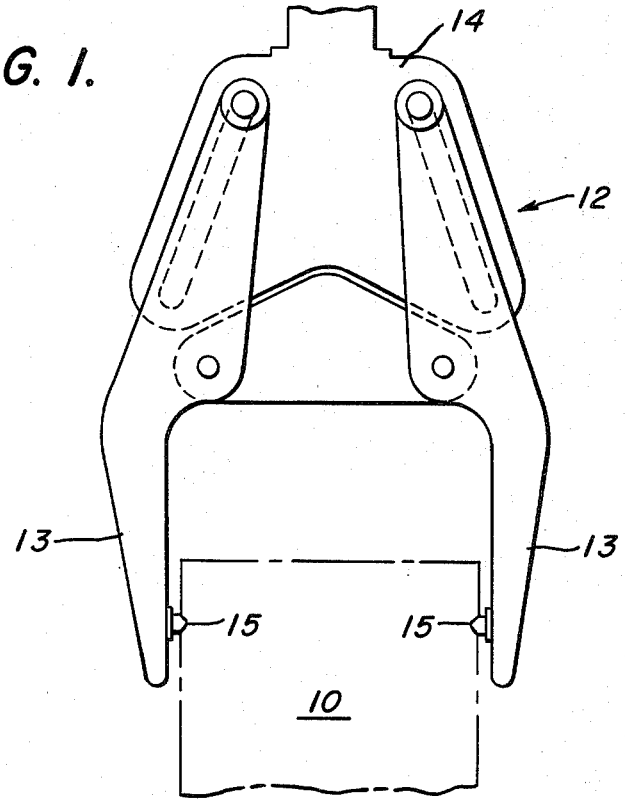
FIG. 1 is a partly diagrammatic side elevational view of an ingot and tongs engaged therewith.

FIG. 1 shows a conventional ingot 10 and tongs 12 for handling and transporting the ingot. The tongs include a pair of opposed relatively movable arms 13 and a mechanism 14, not shown in detail, for operating the arms. The arms are equipped with bits 15 constructed in accordance with our invention for engaging the side faces of the ingot. Our bits of course are not limited to use with tongs of the particular construction illustrated.

Figure 3:
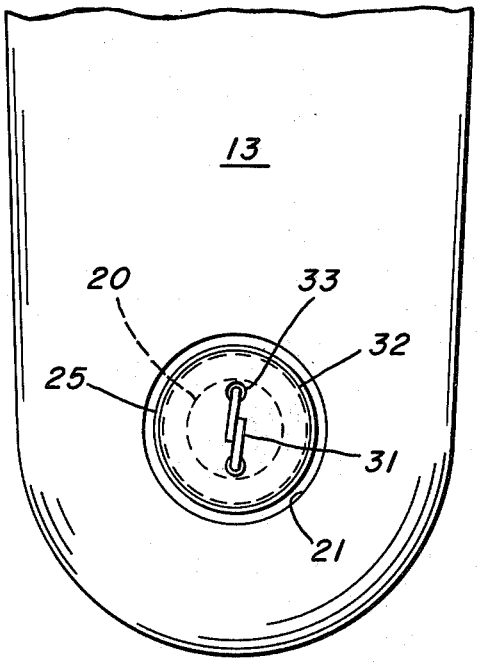
FIG. 3 is an elevational view from the left of FIG. 2.
Figure 2:
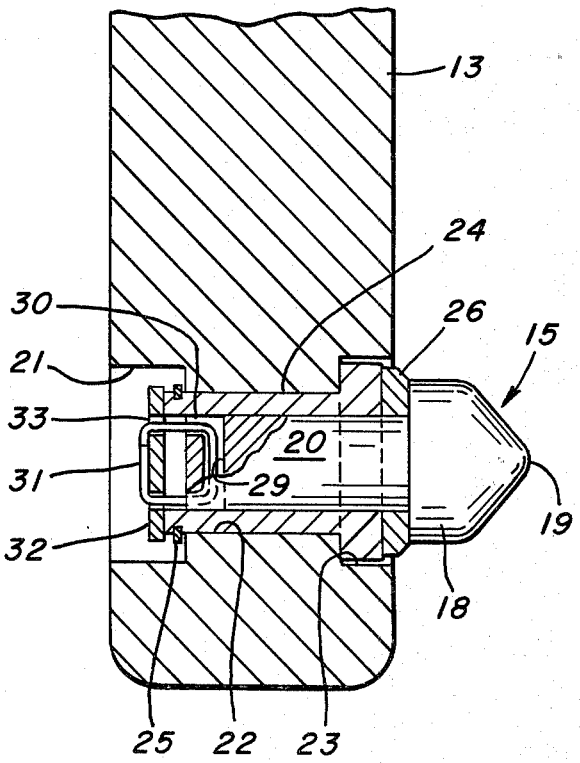
FIG. 2 is a vertical sectional view on a larger scale of the lower end of a tong arm and bit constructed in accordance with our invention.

As FIGS. 2 and 3 show, our bit 15 includes a cylindrical head 18, a conical point 19, and a cylindrical or slightly tapered shank 20 all formed as an integral casting. Although the bit can be of one of the usual steel compositions, we prefer to use a more durable metal, preferably a nickel alloy or a cobalt alloy. The best material we have found is "Inconnel 713C," which is nickel alloy containing nominally 12.5% chromium, 4.2% molybdenum, 6.1% aluminum and small amounts of titanium and zirconium. The tong arm 13 has a recess 21 in its outside face and a bore 22 which extends from the bottom of the recess to the inside face. Preferably the bore 22 has a counterbore 23 at the inside face and receives a flanged bushing 24, which is press-fitted or otherwise immovably fixed in the arm. Preferably also the bushing has an external circumferential groove at the bottom of the recess 21 in which we insert a retainer ring 25. We interpose one or more washers 26 between the bit head 18 and the inside end of the bushing. The bushing and washer conveniently are of the same metal, such as 4140 steel, but in use the washer, rather than the bushing, is exposed to the heat of the ingot and absorbs the most wear. Consequently we find it seldom is necessary to replace the bushing, which is more difficult to remove and replace than the washer.

The bit shank 20 has a transverse hole 29, preferably located along a diameter near its outside end, and a pair of opposed lengthwise grooves 30, which extend along its outer face from the ends of the hole to the outside end of the shank. Before inserting the bit in the bushing 24, we insert a rod 31 through hole 29 and bend the rod to a U-shape so that it lies within grooves 30. After inserting the bit, we place a retainer plate 32 over the outside end of the bushing axially spaced from the end of the shank 20. Plate 32 has holes 33 positioned to receive the two legs of rod 31. We complete the assembly by bending the ends of the rod flat against the outside face of plate 32 and tack-welding them. The plate and rod ends lie entirely within recess 21 of the tong arm 13 and thus do not protrude to a position where they can strike and damage refractories. We can add more washers 26 or use washers of different thickness to adjust the distance by which the point 19 protrudes from the inside face of the tong arm. The point should protrude farther when the tongs are used for handling smaller ingots. Also as the point wears and is dressed, and as hereinafter explained, we may add washers to compensate.

FIG. 4 shows a modification in the fastening means which we utilize for mounting our bit on a tong arm 36 lacking a recess in its outside face. The parts are similarly constructed, except that we rely on the press-fit alone to hold a bushing 37 within a bore 38 in the tong arm. The retainer plate and rod lie within the bore, thus avoiding any protrusion from the outside face of the arm. This modification is particularly useful for applying our bit to an existing tong arm which is not constructed especially for our bit.

Initially the end of point 19 is rounded on a radius of at least about one-half inch and preferably has an apex angle greater than a right angle, for example about 100°. Although we do not claim it as our invention, our experience has shown that a point thus proportioned penetrates the surfaces of an ingot to the extent necessary to grip and support the ingot, but the indentations which it leaves do not ordinarily cause defects. As the point wears in use, it becomes progressively blunter; that is, the radius progressively increases. We have observed that a bit is still serviceable when the radius of the point increases to about 1⅜ inch, but that it no longer is serviceable when the radius reaches about 1⅝ inch.

Preferably we use a guage 41 constructed as shown in FIG. 5 to determine whether a bit is still serviceable after a period of use. The gauge has a central contact area 42 and two side contact areas 43. We place the gauge over the point as shown in FIG. 5. If the center contact area 42 makes contact with the apex of the point, the bit is serviceable. If the side contact areas 43 make contact with the conical sides of the point and the central contact area fails to make contact with the apex, as shown in FIG. 5, the bit no longer is serviceable. Preferably the head 18 of our bit has an axial length sufficient that the point can be dressed about four times after it has become too blunt by the measurement described. As the head becomes thinner, washers 26 can be added or a thicker washer used to return the point to its original position.

FIG. 6 illustrates our handling method. The shank 20 of the bit is freely rotatable in the bushing 24. When the tongs 12 pick up an ingot 10, they normally contact the ingot slightly off center. In FIG. 6 the distance $x$ from the point of engagement to the left side is slightly greater than the distance $y$ to the right side. Consequently the ingot assumes a position slightly askew from upright. When the tongs set the ingot on a surface 44, the ingot returns to an upright position and rotates clockwise through a small arc. The bits 15 rotate with the ingot. Thus they move to a position in which a fresh area of the point 19 faces upwardly. The bit also tends to rotate whenever the point scrapes across the surface of an ingot as the tongs pick up or disengage the ingot. With repeated use, all areas of the point eventually face upwardly in turn, whereby the point wears uniformly around its full circumference. We need not water-cool the bit after each use.

From the foregoing description, it is seen that our invention affords an improved bit and tong-and-bit combination which greatly prolong the useful life of a bit. This benefit is achieved by forming the bit of a more durable metal, by distributing wear around the circumference of the point, and by proportioning the head and point so that the point can be repeatedly dressed after it becomes too blunt. Our combination also avoids any protrusion from the outside faces of the tong arms, and makes it possible to adjust the distance by which the point protrudes from the inside faces. Our handling method assures that the bit rotates with each use to distribute wear. Although the preferred nickel alloy of which we form the bit is substantially more costly than steel, our invention reduces the total cost for bits many fold.

We claim:

1. A bit for ingot tongs, said bit comprising a cylindrical head, a single blunt conical point, and a cylindrical or slightly tapered shank all formed as an integral casting, said shank having an end opposite said head, a transverse hole and lengthwise grooves in its outer surface extending from the ends of said hole to the end of said shank, said hole being adapted to receive a rod and said grooves to receive bent portions of the rod to serve as fastening means for the bit.

2. A bit as defined in claim 1 formed of a material of the goup consisting of nickel alloy and cobalt alloy.

3. A bit as defined in claim 1 in which said point initially is rounded with a radius of at least about one-half inch and said head is proportioned to permit said point to be redressed repeatedly after it wears to a radius of about 1⅝ inch.

4. A bit as defined in claim 1 formed of a nickel alloy containing nominally 12.5% chromium, 4.2% molybdenum, 6.1% aluminum and small amounts of titanium and zirconium.

5. In combination, a bit as defined in claim 1 and a bendable rod within said hole.

6. In combination, a tong arm, a bit, and means fastening said bit to said tong arm;

said tong arm having a recess in its outside face and a bore extending from the bottom of the recess to the inside face;

said bit comprising a cylindrical head, a conical point, and a cylindrical or slightly tapered shank all formed as an integral casting, said shank having a transverse hole and lengthwise grooves in its outer surface extending from the ends of said hole to its outside end;

said fastening means comprising a bushing fixed in said bore and rotatably receiving said shank, a rod bent to U-shape received in said hole and said grooves, a retainer plate overlying the outside end of said bushing and having holes through which said rod being bent flat against said retainer plate, and at least one washer interposed between the inside end of said bushing and said head;

said retainer plate and the bent end portions of said rod being confined with said recess to avoid protrusions from the outside face of said tong arm;

said washer permitting adjustment in the distance by which said point protrudes from the inside face of said tong arm.

7. A combination as defined in claim 6 in which said fastening means further comprises a retainer ring fixed to said bushing at the bottom of said recess.

8. A combination as defined in claim 6 in which said bit is formed of a material of the group consisting of nickel alloy and cobalt alloy.

9. In combination, a bit, a tong arm, and means fastening said bit to said tong arm;

said bit comprising a cylindrical head, a single blunt conical point, and a cylindrical or slightly tapered shank all formed as an integral casting;

said tong arm having inside and outside faces and a bore extending therethrough;

said fastening means comprising a bushing fixed within said bore and receiving said shank, and means on said shank confined between the faces of said tong arm retaining said shank within said bushing;

said head and said point protruding from the inside face of said tong arm;

said shank being rotatable within said bushing, whereby wear on said point is distributed around the circumference.

10. A combination as defined in claim 9 in which said tong arm has a recess in its outside face, and said fastening means is located within said bore and said recess.

11. A combination as defined in claim 10 in which said fastening means further comprises a retainer ring holding said bushing within said bore.

12. A combination as defined in claim 9 in which said shank has a transverse hole and lengthwise grooves in its outer surface extending from the ends of said hole to its outside end, and said fastening means comprises a rod bent to U-shape received in said hole and said grooves, and a retainer plate overlying the outside end of said bushing and having holes through which said rod extends, the end portions of said rod being bent flat against said retainer plate.

13. A combination as defined in claim 9 in which the distance by which said point protrudes from inside face of said tong arm is adjustable.

14. A combination as defined in claim 9 in which said fastening means further comprises at least one washer interposed between the inside end of said bushing and said head to absorb wear and permit adjustment in the distance by which said point protrudes from the inside face of said tong arm.

15. A combination as defined in claim 9 in which said point initially is rounded with a radius of at least about one-half inch, and said head is proportioned to permit said point to be redressed repeatedly after it wears to a radius of about 1⅝ inch, said fastening means being adjustable to adjust the distance by which said head protrudes from said inside face to compensate for redressing said point.

* * * * *